US006199209B1

(12) United States Patent
Aoki

(10) Patent No.: US 6,199,209 B1
(45) Date of Patent: Mar. 13, 2001

(54) GLOVE OR MITT

(75) Inventor: Akio Aoki, Hirakata (JP)

(73) Assignee: Trion Corporation (JP)

( * ) Notice: Subject to any disclaimer, the term of this patent is extended or adjusted under 35 U.S.C. 154(b) by 0 days.

(21) Appl. No.: 09/531,991

(22) Filed: Mar. 20, 2000

(30) Foreign Application Priority Data

Jan. 31, 2000 (JP) ..... 12-022705

(51) Int. Cl.[7] ..... A41D 13/08
(52) U.S. Cl. ..... 2/19
(58) Field of Search ..... 2/19, 161, 162

(56) References Cited

U.S. PATENT DOCUMENTS 3,602,915 9/1971 Collins .
3,721,996 * 3/1973 Nadorf ..... 2/19
4,651,345 * 3/1987 Latina ..... 2/19
4,853,975 * 8/1989 Clevenhagen ..... 2/19
5,031,239 * 7/1991 Panichello et al. ..... 2/19
5,457,819 10/1995 Aoki ..... 2/19
5,717,995 * 2/1998 Murai ..... 2/19

* cited by examiner

*Primary Examiner*—John J. Calvert
*Assistant Examiner*—Gary L. Welch
(74) *Attorney, Agent, or Firm*—Webb Ziesenheim Logsdon Orkin & Hanson, P.C.

(57) ABSTRACT

A glove or a mitt comprising a first outer skin corresponding to a palm side, a second outer skin corresponding to a back side of a hand and joined to the first outer skin, a forefinger of the hand being able to be placed on an outside of the second outer skin, and a forefinger support body provided to the second outer skin for positioning and supporting the forefinger on the outside of the second outer skin, a position of the forefinger support body being able to be adjusted in a direction corresponding to a width of the hand.

9 Claims, 3 Drawing Sheets

GLOVE OR MITT

BACKGROUND OF THE INVENTION

1. Field of the Invention

The present invention relates to a glove or a mitt used for baseball, softball, and the like.

2. Description of the Related Art

As the above glove, there are gloves of an opening type having a large opening on a hand insertion opening portion side of an outer skin on a side corresponding to a back of the hand when viewed from behind and a totally-closed type in which the outer skin extends from a side corresponding to fingertips to a side corresponding to a wrist without having an opening. In use of these gloves, many users use them with their forefingers placed on an outside of the outer skin.

This is because placing the forefinger that is the most suitable to exact motions in respective fingers on the outside of the outer skin improves a balance of the glove to enable the user to easily catch a ball and allows a shock in catching the ball to be absorbed in the glove.

Incidentally, the glove of the opening type is used with the forefinger passed through the opening portion in the outer skin to the outside of the outer skin while the glove of the totally-closed type is used with the forefinger inserted through a forefinger insertion hole formed in the outer skin (see U.S. Pat. No. 5,457,819, for example).

Conventionally, the above glove of the opening type simply has a structure in which the forefinger can be passed through the opening portion to be placed on the outside of the outer skin as means for enabling the forefinger to be placed on the outside of the outer skin such that the forefinger can move freely in a width direction of the hand on the outside of the outer skin.

On the other hand, the glove of the totally-closed type is simply formedwith the forefinger insertion hole in the outer skin such that the forefinger is positioned in a fixed position on the outside of the outer skin as disclosed in the above U.S. Pat. No. 5,457,819.

According to the above conventional glove of the opening type, because the forefinger can move freely on the outside of the outer skin, the forefinger may be displaced from a position where the forefinger was placed before catching the ball by a shock of the catching motion to degrade ease of use of the glove.

A position of the forefinger (on the outside of the outer skin) that makes the glove easy to use is different for each user. For example, a user feels it easy to use the glove with his or her forefinger placed close to his or her middle finger while another feels it easy to use the glove with his or her forefinger placed close to his or her thumb.

According to a structure of the conventional glove of the totally-closed type, because the forefinger is positioned in a fixed position on the outside of the outer skin, some users feel that the gloveis difficult to use even if their forefingers are placed on the outside of the outer skin in use of the glove.

SUMMARY OF THE INVENTION

The present invention has been accomplished with the existing condition of the above prior art in view, and it is an object of the present invention to provide a glove in which differences in ease of use of the glove among users are suppressed and more users feel it easy to use the glove by enabling each user to choose an appropriate condition of use of the glove according to his or her habit, liking, and the like.

The above object is achieved by inventions stated in claims. In other words, in a characteristic structure of the invention, a forefinger can be placed on an outside of an outer skin corresponding to a back side of a hand and a forefinger support body for positioning and supporting the forefinger on the outside of the outer skin is provided to the outer skin such that a position of the forefinger support body can be adjusted in a direction corresponding to a width direction of the hand.

With this structure, the glove with the above structure is used in a state in which the forefinger is placed on the outside of the outer skin and positioned and supported on the forefinger support body. Thus, displacement of the forefinger in a catching motion can be prevented.

Because the position of the forefinger support body can be adjusted in the width direction of the hand, a user who feels that the glove is easier to use with his or her forefinger positioned close to his or her middle finger can use the glove with the above structure after adjusting the position of the forefinger support body such that his or her forefinger is placed close to his or her middle finger, for example.

A user who feels that the glove is easier to use with his or her forefinger positioned close to his or her thumb can use the glove after adjusting the forefinger support body such that his or her forefinger is placed close to his or her thumb. In other words, the forefinger that is the most suitable to exact motions in respective fingers can be placed in a desired position on the outside of the outer skin.

Therefore, according to this invention, it is possible to prevent displacement of the forefinger in the catching motion and to position the forefinger in the desired position on the outside of the outer skin, thereby providing the glove in which differences in ease of use of the glove among users can be suppressed and more users feel it easy to use the glove.

It is preferable that the forefinger support body is formed by forming a forefinger insertion hole through which the forefinger is passed on a forefinger support member.

With this structure, because the forefinger support body is formed by forming the forefinger insertion hole through which the forefinger is passed on the forefinger support member, it is possible to avoid complication of the structure of the forefinger support body, thereby further simplifying the structure.

Furthermore, it is preferable that a finger cover into which the forefinger passed through the forefinger insertion hole is inserted is provided to the forefinger support member.

With this structure, because the finger cover is provided to the forefinger support member, the forefinger can be supported more reliably and can be positioned easily. Moreover, an effect of protecting the forefinger in catching a ball that has flown to the vicinity of a fence of a ballpark can be obtained.

It is preferable that a size of the hand insertion opening on a side opposite to a side corresponding to fingertips can be adjusted by enlarging/reducing adjusting means and that the enlarging/reducing adjusting means is also used as position adjusting means of the forefinger support body in the width direction of the hand.

With this structure, because the size of the hand insertion opening can be adjusted by the enlarging/reducing adjusting means, it is advantageously easy to bring the glove with the above structure into close contact with the hand by reducing a diameter of the opening portion after inserting the hand into the hand insertion opening portion.

Because the enlarging/reducing adjusting means is also used as the position adjusting means of the forefinger support body in the width direction of the hand, it is possible to avoid increase in the number of parts and it is easy to carry out the enlarging/reducing adjustment and the position adjustment as compared with a case in which the enlarging/reducing adjusting means and the position adjusting means are formed separately.

Therefore, according to this invention, the glove is easier to use with the further simplified structure and it is possible to save the user time and trouble in putting on the glove.

Furthermore, it is preferable that the forefinger support body is formed by attaching a portion of the forefinger support body on the side corresponding to the fingertips to the outer skin and that a portion of the outer skin on the side of the hand insertion opening portion is split into two parts along a direction corresponding to a longitudinal direction of the hand.

Moreover, it is preferable that the enlarging/reducing adjusting means comprising a band material first insertion portion which is formed on one split part of the outer skin and into which band material is inserted, an end portion of the band material being attached to the one split part of the outer skin, a band material second insertion portion which is formed on the other split part of the outer skin and into which the band material from the band material first insertion portion side is inserted, a band material third insertion portion into which the band material from the band material second insertion portion side is inserted, a band material fourth insertion portion which is formed on the forefinger support body and into which the band material from the band material third insertion portion side is inserted, and a band material fixing portion for fixing a portion of the band material from the band material fourth insertion portion side to a portion of the band material on the one split part side of the outer skin.

According to this structure, it is advantageously possible to insert one hand through the hand insertion opening portion, position and support the forefinger of the hand by the forefinger support body, and to position the forefinger in a desired position in the width direction of the hand.

In other words, a user who feels that the glove is easier to use with his or her forefinger positioned close to his or her middle finger can place his or her forefinger in such a position while a user who feels that the glove is easier to use with his or her forefinger positioned close to his or her thumb can place his or her forefinger in such a position.

Because the forefinger support body is formed by attaching the portion of the forefinger support body on a fingertips side to the outer skin, a position of the forefinger support body can be changed freely in the direction corresponding to the width of the hand.

In this state, a tip end side of the band material is pulled and the strap portion from the band material fourth insertion portion side is fixed to the one split part of the outer skin or the band material portion on the one split part of the outer skin by using the other hand.

Thus, the band material can be tightened to fix the forefinger support body to a position in the hand width direction and both the split parts of the outer skin are drawn toward each other to reduce the diameter of the hand insertion opening portion and to bring the outer skin portion and the like constituting the hand insertion opening portion into contact with a wrist side.

DETAILED DESCRIPTION OF THE PREFERRED EMBODIMENTS

The embodiments of the glove according to the present invention will be specifically described by reference to the drawings.

Figure 1:
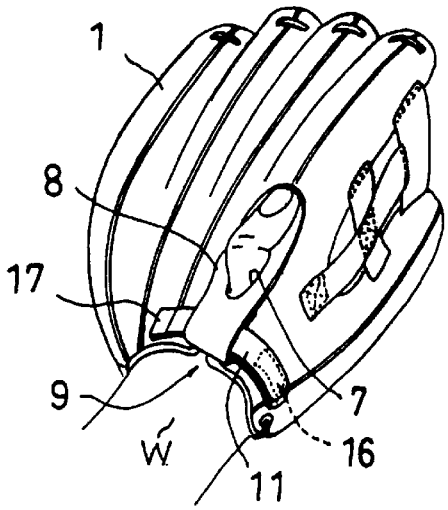
FIG. 1 is a perspective view of a state in which a glove of an embodiment of the present invention is used.

FIG. 1 is a baseball glove (corresponding to a glove) of a totally-closed type in which a first outer skin 1 on a side corresponding to a back of a hand extends from a side corresponding to fingertips to a side corresponding to a wrist W without having an opening.

Figure 2:
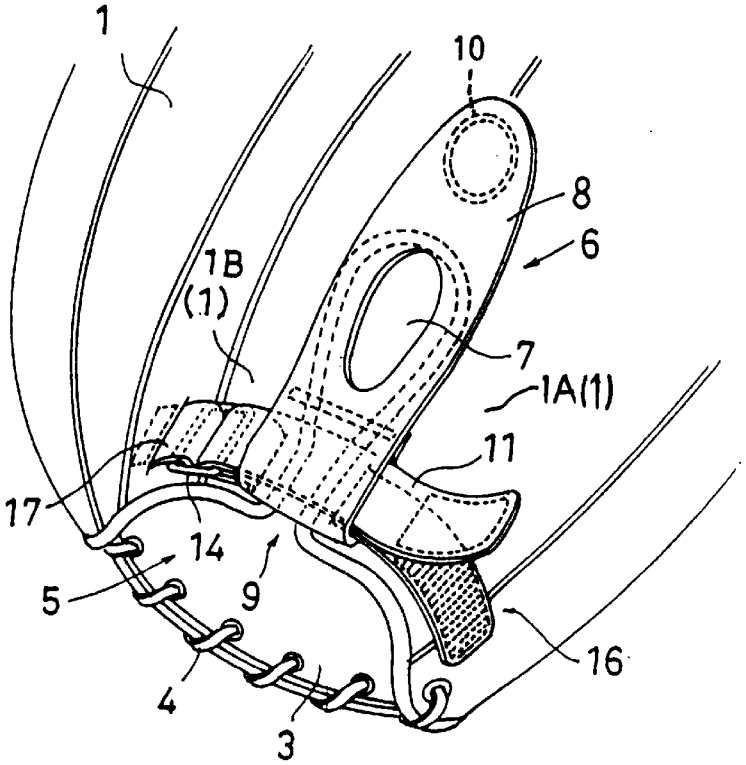
FIG. 2 is a perspective view of an essential portion of the glove in FIG. 1.
Figure 3:
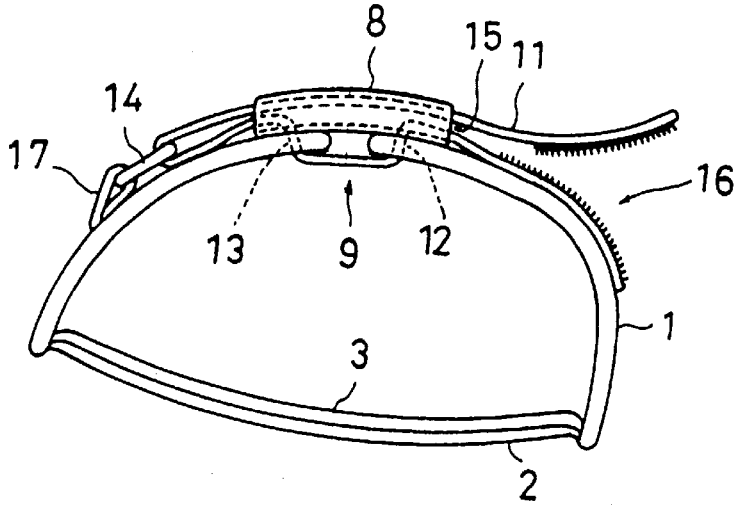
FIG. 3 shows the glove in FIG. 1 viewed from a side of a hand insertion opening portion.

As shown in FIGS. 1 to 3, the glove is formed by joining the first outer skin 1, a second outer skin 2 on a ball-receiving side, an inner skin 3 inside the second outer skin 2, and the like to each other by using leather strap 4 and the like.

A portion of the first outer skin on a hand insertion opening portion 5 side that is opposite to the side corresponding to the fingertips is split into two parts along a longitudinal direction of the hand and the forefinger can protrude from the split portion on an outside of the first outer skin. A forefinger support body 6 for positioning and supporting the forefinger on the outside of the first outer skin 1 is provided to the first outer skin 1 such that a position of the forefinger support body 6 is adjustable in a width direction of the hand.

The forefinger support body 6 has a longitudinally elongated forefinger insertion hole 7 through which the forefinger is passed and which is formed on a forefinger support member 8 in a shape of a leather belt. A portion of the forefinger support member on a fingertips side of the forefinger insertion hole 7 is sewn on the first outer skin 1. A reference numeral 10 designates a seam.

A size of the hand insertion opening portion 5 is adjustable by using enlarging/reducing adjusting means 9. The enlarging/reducing adjusting means 9 is also used as position adjusting means for the forefinger support member 8 in the width direction of the hand.

Specifically, the enlarging/reducing adjusting means 9 is constituted in a manner described in the following [1] to [3].

[1] An end portion of a strap 11 (corresponding to band material) as band material is sewn on one split part 1A of the first outer skin and a first insertion hole 12 (corresponding to a band material first insertion portion) into which the strap 11 is inserted from an outside to an inside is formed in the one split part 1A of the first outer skin.

[2] A second insertion hole 13 (corresponding to a band material second insertion portion) into which the strap 11 is inserted from an inside to an outside and a rectangular ring 14 (corresponding to a band material third insertion portion) into which the strap 11 is inserted from a second insertion hole 13 side are provided to the other split part 1B of the first outer skin.

[3] The forefinger support member 8 is formed with a fourth insertion hole 15 (corresponding to a band material fourth insertion portion) into which the strap 11 is inserted from an angular ring 14 side and hook and loop type fasteners 16 (corresponding to band material fixing portions) through which a strap portion from a fourth insertion hole 15 side is superimposed on and fixed to the strap portion on the one split part 1A of the first outer skin are provided.

The angular ring 14 is supported by a ring-shaped leather band 17 sewn on the other split part 1B of the first outer skin. The fourth insertion hole 15 is formed by bending and sewing a free end portion of the forefinger support member 8.

The above glove is attached to the hand in the following manner.

One hand is inserted through the hand insertion opening portion 5, the forefinger of the hand is passed through the forefinger insertion hole 7, and the forefinger is allowed to be positioned in a desired position in the width direction of the hand.

In other words, a user who feels that the glove is easier to use with his or her forefinger positioned close to his or her middle finger can place his or her forefinger in such a position while a user who feels that the glove is easier to use with his or her forefinger positioned close to his or her thumb can place his or her forefinger in such a position.

Because the forefinger support body 6 is formed by attaching the portion of the forefinger support member on a fingertips side of the forefinger insertion hole 7 to the first outer skin 1, a position of the forefinger support body 6 can be changed freely in the direction corresponding to the width of the hand.

In this state, a tip end side of the strap 11 is pulled and the strap portion from the fourth insertion hole 15 side is superimposed on and fixed to the strap portion on the one split part 1A of the first outer skin through the hook and loop type fasteners 16 by using the other hand.

Thus, the strap 11 can be tightened to fix the forefinger support body 6 to a position in the hand width direction and both the split parts 1A and 1B of the first outer skin are drawn toward each other to reduce a diameter of the hand insertion opening portion 5 and to bring the outer skin portion and the like constituting the opening portion 5 into contact with a wrist W side.

[Other Embodiments of the Invention]

Figure 4:
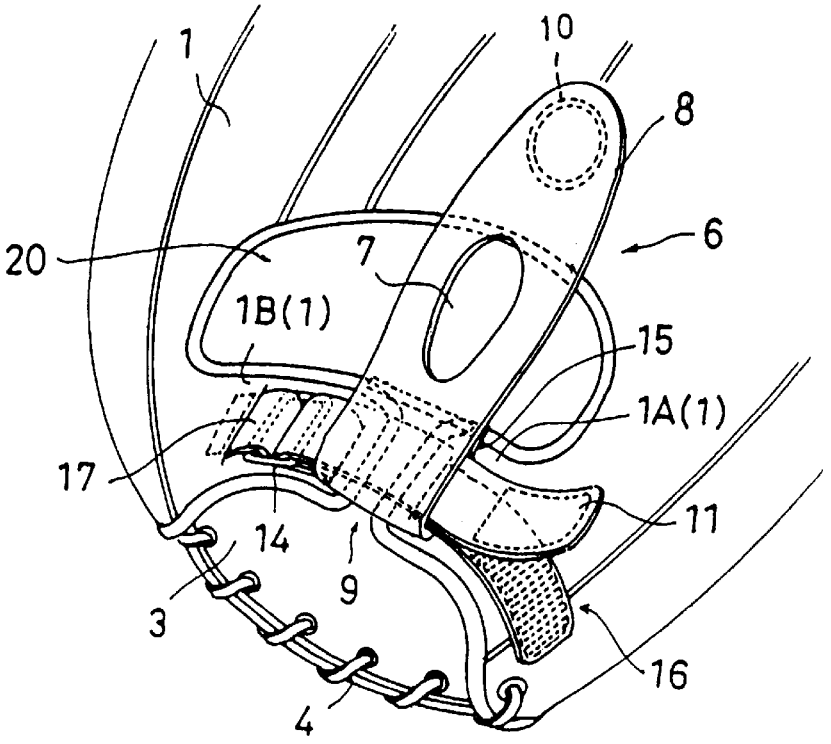
FIG. 4 is a perspective view of an essential portion of a glove of another embodiment.

(1) As shown in FIG. 4, the glove of the present embodiment can be also applied to the glove of the opening type having the large opening on the hand insertion opening portion 5 side of the first outer skin 1. This glove of the opening type is different from the glove of the above-described embodiment in that the opening type is formed with an opening 20 and other structures of the opening type are the same as those of the above embodiment.

Figure 5:
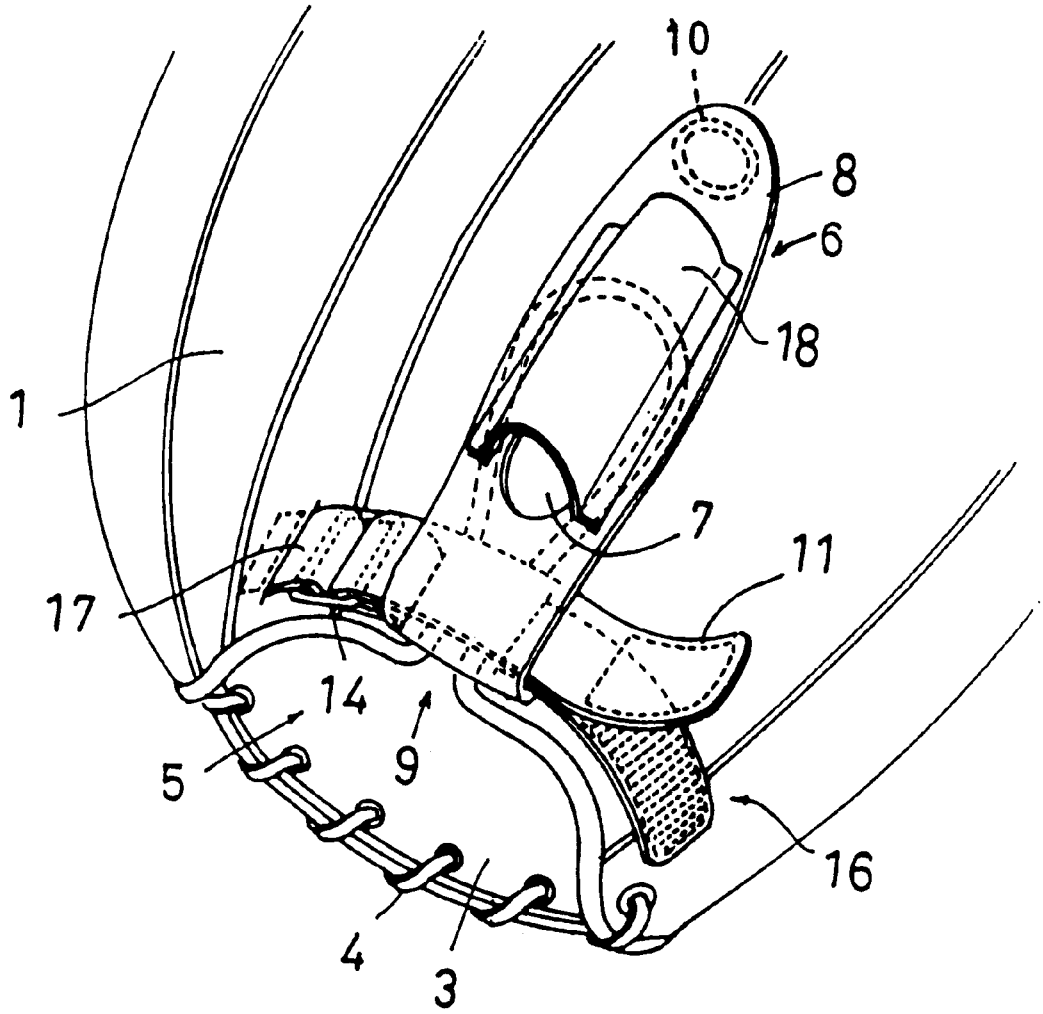
FIG. 5 is a perspective view of an essential portion of a glove of yet another embodiment.

(2) Furthermore, as shown in FIG. 5, a finger cover 18 into which the forefinger passed through the forefinger insertion hole 7 is inserted can be provided to the forefinger support member 8 constituting the forefinger support body.

(3) The enlarging/reducing adjusting means 9 is not limited to the above-described structure, but may be in other shapes. The forefinger insertion hole 7 is not limited to the above-described shape, but may be in a circular shape, a polygonal shape, or other shapes, for example.

(4) Although the portion of the forefinger support member on the fingertips side of the forefinger insertion hole 7 is sewn on the first outer skin 1 in the above embodiment, the portion of the forefinger support member may be riveted to the first outer skin 1 instead.

(5) The present invention can be also applied to a catcher's mitt and a first baseman's mitt. The invention can be also applied to a glove, a catcher's mitt, and a first baseman's mitt for softball.

(6) Although the examples of the glove for a right-handed user are shown in the above embodiments, the invention can be naturally applied to a glove for a left-handed user.

What is claimed is:

1. A glove or a mitt comprising:

a first outer skin corresponding to a back side of a hand, a forefinger of said hand being able to be placed on an outside of said first outer skin, a second outer skin corresponding to a palm side of the hand and joined to said first outer skin, and a forefinger support body provided to said first outer skin for positioning and supporting said forefinger on said outside of said first outer skin, a position of said forefinger support body being able to be adjusted in a direction corresponding to a width of said hand, said forefinger support body formed by forming a forefinger insertion hole through which said forefinger is passed on a forefinger support member, and said forefinger support member fixed on a fingertip end side in a longitudinal direction of said forefinger to said first outer skin and movable in said direction corresponding to said width of said hand on a base side of said forefinger.

2. A glove or a mitt according to claim 1, further comprising a finger cover which is provided to said forefinger support member and into which said forefinger passed through said forefinger insertion hole is inserted.

3. A glove or a mitt according to claim 1, further comprising enlarging/reducing adjusting means of a hand insertion opening side for adjusting a size of said hand insertion opening on a side opposite to a side corresponding to fingertips and used also as position adjusting means of said forefinger support body in said width direction of said hand.

4. A glove or a mitt according to claim 3, wherein said forefinger support body is formed by attaching a portion of said forefinger support body on said side corresponding to said fingertips to said first outer skin, and a portion of said first outer skin on said side of said hand insertion opening portion is split into two parts along a direction corresponding to a longitudinal direction of said hand.

5. A glove or a mitt according to claim 1, wherein a large opening is formed on a hand insertion opening portion side of said first outer skin.

6. A glove or a mitt according to claim 5, further comprising enlarging/reducing adjusting means of said hand insertion opening portion side for adjusting a size of said hand insertion opening on a side opposite to a side corresponding to fingertips and used also as position adjusting means of said forefinger support body in said width direction of said hand.

7. A glove or a mitt according to claim 6, wherein said forefinger support body is formed by attaching a portion of said forefinger support body on said side corresponding to said fingertips to said first outer skin, and a portion of said first outer skin on said side of said hand insertion opening portion is split into two parts along a direction corresponding to a longitudinal direction of said hand.

8. A glove or a mitt comprising:

a first outer skin corresponding to a back side of a hand, a forefinger of said hand being able to be placed on an outside of said first outer skin, a second outer skin corresponding to a palm side of the hand and joined to said first outer skin, a forefinger support body provided to said first outer skin for positioning and supporting said forefinger on said outside of said first outer skin, a position of said forefinger support body being able to be adjusted in a direction corresponding to a width of said hand, and enlarging/reducing adjusting means of a hand insertion opening side for adjusting a size of said hand insertion opening on a side opposite to a side corresponding to fingertips and used also as position adjusting means of said forefinger support body in said width direction of said hand, wherein said forefinger support body is formed by attaching a portion of said forefinger support body on said side corresponding to said fingertips to said first outer skin, and a portion of said first outer skin on said side of said hand insertion opening portion is split into two parts along a direction corresponding to a longitudinal direction of said hand, and wherein said enlarging/reducing adjusting means comprises:

a band material first insertion portion which is formed on one split part of said first outer skin and into which band material is inserted, an end portion of said band material being attached to said one split part of said first outer skin, a band material second insertion portion which is formed on the other split part of said first outer skin and into which said band material from said band material first insertion portion side is inserted, a band material third insertion portion into which said band material from said band material second insertion portion side is inserted, a band material fourth insertion portion which is formed on said forefinger support body and into which said band material from said band material third insertion portion side is inserted, and a band material fixing portion for fixing a portion of said band material from said band material fourth insertion portion side to a portion of said band material on said one split part side of said first outer skin.

9. A glove or a mitt comprising:

a first outer skin corresponding to a back side of a hand, a forefinger of said hand being able to be placed on an outside of said first outer skin, a second outer skin corresponding to a palm side of the hand and joined to said first outer skin, a forefinger support body provided to said first outer skin for positioning and supporting said forefinger on said outside of said first outer skin, a position of said forefinger support body being able to be adjusted in a direction corresponding to a width of said hand, a large opening formed on a hand insertion opening portion side of said first outer skin, and enlarging/reducing adjusting means of a hand insertion opening portion side for adjusting a size of said hand insertion opening on a side opposite to a side corresponding to fingertips and used also as position adjusting means of said forefinger support body in said width direction of said hand, wherein said forefinger support body is formed by attaching a portion of said forefinger support body on said side corresponding to said fingertips to said first outer skin, and a portion of said first outer skin on said side of said hand insertion opening portion is split into two parts along a direction corresponding to a longitudinal direction of said hand, and wherein said enlarging/reducing adjusting means comprises:

a band material first insertion portion which is formed on one split part of said first outer skin and into which band material is inserted, an end portion of said band material being attached to said one split part of said first outer skin, a band material second insertion portion which is formed on the other split part of said first outer skin and into which said band material from said band material first insertion portion side is inserted, a band material third insertion portion into which said band material from said band material second insertion portion side is inserted, a band material fourth insertion portion which is formed on said forefinger support body and into which said band material from said band material third insertion portion side is inserted, and a band material fixing portion for fixing a portion of said band material from said band material fourth insertion portion side to a portion of said band material on said one split part side of said first outer skin.

* * * * *